US008291741B2

(12) United States Patent
Domange et al.

(10) Patent No.: US 8,291,741 B2
(45) Date of Patent: Oct. 23, 2012

(54) FORMING TOOL COMPRISING COOLING DUCT BORES BRANCHED WITHIN TOOL ELEMENTS

(75) Inventors: Nicolas Domange, Courbevoie (FR); Jens Overrath, Wunstorf (DE)

(73) Assignees: ThyssenKrupp Sofedit S.A.S., Saint-Quentin-en-Yvelines (FR); ThyssenKrupp Umformtechnik GmbH, Ludwigsfelde (DE)

( * ) Notice: Subject to any disclaimer, the term of this patent is extended or adjusted under 35 U.S.C. 154(b) by 294 days.

(21) Appl. No.: 12/787,645

(22) Filed: May 26, 2010

(65) Prior Publication Data

US 2011/0219841 A1 Sep. 15, 2011

(30) Foreign Application Priority Data

Mar. 11, 2010 (DE) ..... 10 2010 011 188

(51) Int. Cl.
*B21D 37/16* (2006.01)

(52) U.S. Cl. ..... 72/342.5

(58) Field of Classification Search ..... 72/342.1, 72/342.2, 342.3, 342.5, 342.6
See application file for complete search history.

(56) References Cited

U.S. PATENT DOCUMENTS

| | | | | |
|---|---|---|---|---|
| 6,033,499 | A * | 3/2000 | Mitra | 148/688 |
| 6,463,779 | B1 * | 10/2002 | Terziakin | 72/342.96 |
| 6,742,374 | B2 * | 6/2004 | Ozawa | 72/342.5 |
| 2006/0138698 | A1 | 6/2006 | Chapuis | |

FOREIGN PATENT DOCUMENTS

DE 102007047314 A1 4/2009

* cited by examiner

*Primary Examiner* — Faye Francis
(74) *Attorney, Agent, or Firm* — The Webb Law Firm

(57) ABSTRACT

The invention relates to a forming tool for hot forming, including a plurality of tool elements resting against one another and which define a forming surface, wherein the forming surface is embodied so as to be complementary to at least one section of a formed sheet component, which is to be produced by way of hot forming, and wherein the tool elements include cooling ducts in the form of bores which extend along the forming surface. At least two of the tool elements in each case include at least one cooling duct, which branches within the tool element into at least two cooling duct branches, wherein the bore axes of the cooling duct branches, which diverge or converge, respectively, extend along the forming surface. Through this, a generic forming tool is created, which provides for a high, uniform cooling capacity across a large forming surface.

12 Claims, 8 Drawing Sheets

FORMING TOOL COMPRISING COOLING DUCT BORES BRANCHED WITHIN TOOL ELEMENTS

The invention relates to a forming tool for hot forming, in particular press-hardening sheet metal, comprising a plurality of tool elements, which rest against one another and which define a forming surface, wherein the forming surface is embodied so as to be complementary to at least one section of a formed sheet component, which is to be produced by means of hot forming, and wherein the tool elements comprise cooling ducts in the form of bores, which extend along the forming surface.

In the case of hot forming of sheet steel, sheet steel blanks are heated in a heat treatment device to austenitization temperature, are subsequently placed into a forming tool (pressing tool) in the hot state and are re-shaped. While still clamped in the forming tool, the formed sheet components are hardened by means of cooling of the forming tool. By simultaneously forming and cooling the hot steel blanks after the austenitization, a martensitic structure is attained in the end product, which gives the component a yield strength and a tensile strength above 1000 MPa or 1500 MPa, respectively. Typically, the sheet steel used here are boron-alloyed steel grades, for example the steel grade 22MnB5. Press-hardened sheet steel formed parts are characterized by a high to very high strength with relatively low component weight.

Known forming tools for press-hardening sheet steel comprise drilled cooling ducts for the circulation of cooling medium.

Forming tools are furthermore known for press-hardening sheet steel, the male mold and female mold of which are in each case formed from an outer part, which defines the forming surface and from an inner part (insertion part), which is complementary thereto, wherein a cooling duct for the circulation of cooling medium is embodied in at least one of the surfaces of the outer part and of the inner part, which face one another, namely by means of milling and/or during the casting of the outer part or inner part, respectively (see DE 10 2007 047 314 A1). The production of the outer and inner parts of such forming tools, which rest against one another in a complementary manner, is very complex, wherein in particular the leakage-free sealing of the cooling duct, which runs in the area of the jointing plane between outer and inner part, is difficult.

A forming tool for press-hardening sheet metal is known from US 2006/0138698 A1, the male mold and female mold of which are in each case assembled from a plurality of disk-shaped tool elements, which are connected to one another, wherein the surfaces of the tool elements of the male mold or of the female mold, respectively, which rest against one another, in each case run crosswise to the longitudinal axis of the forming tool or of the sheet component, which is to be produced therein by means of hot forming. The disk-shaped tool elements of the male mold or of the female mold, respectively, comprise in each case sections of drilled distribution or collection ducts, respectively, for cooling medium, which are in contact with one another, wherein cooling ducts, which branch off from the distribution or collection duct, respectively, and which run contour-parallel to the forming surface of the respective disk-shaped tool element are milled in the surfaces of the tool elements, which rest against one another. The leakage-free sealing of the disk-shaped tool elements, which rest against one another, should be possible in a more simple and more reliable manner than in the case of the forming tools according to DE 10 2007 047 314 A1. The production of the forming tool known from US 2006/0138698 A1, however, is very time-consuming and cost-intensive due to the high number of the disk-shaped tool elements. In addition, the cooling duct arrangement, which is characterized by a plurality of milled cooling ducts, which extend crosswise to the longitudinal axis of the molding tool, as well as by a small number of cooling water connections at the distribution or collection ducts, respectively, leads to a very uneven flow rate in the individual milled cooling ducts and thus to a correspondingly uneven cooling efficiency across the respective forming surface.

The instant invention is based on the object of creating a forming tool (pressing tool), which provides for a high and even cooling efficiency across a large forming surface and which can be produced in a comparatively inexpensive manner.

This object is solved by means of a forming tool comprising the features specified in claim 1.

The forming tool according to the invention is composed of a plurality of tool elements, which rest against one another and which define a forming surface, wherein the forming surface is embodied so as to be complementary to at least one section of a formed sheet component, which is to be produced by means of hot forming, and wherein the tool elements comprise cooling ducts in the form of bores, which extend along the forming surface. According to the invention, at least two of the tool elements in each case comprise at least one cooling duct, which branches within the tool element into at least two cooling duct branches, wherein the bore axes of the cooling duct branches, which diverge or converge, respectively, extend along the forming surface.

Executing the cooling ducts as bores is advantageous with respect to manufacturing. This is so because the bores can be produced in a comparatively cost-efficient manner and are sealed reliably due to their radial distance towards the forming surface of the tool elements in this respect. In addition, the bore ends of the tool elements, which rest against one another and which are assigned to one another, can be connected in a leakage-free manner in a relatively simple manner. On the one hand, the branching of the drilled cooling ducts within the workpiece parts makes it possible to be able to better adapt the course of the cooling ducts to the contour course of the forming surface or of the sheet component, respectively, which is to be produced. On the other hand, the cooling duct arrangement according to the invention makes it possible to keep the division of the forming tool into tool elements, which rest against one another, to be as small as possible. The smaller the division of the forming tool into a plurality of tool elements, which rest against one another, the smaller the production effort for the forming tool and the smaller the required effort for mutually sealing the tool elements. In particular, the embodiment and arrangement of the cooling ducts according to the invention makes it possible to attain a very high flow rate of the cooling medium in the cooling ducts as well as a relatively constant flow rate distribution across the adjacent cooling ducts, thus resulting in a correspondingly high as well as even cooling efficiency based on the forming surface of the forming tool. However, it also lies within the scope of the invention to specifically influence the cooling efficiency, in particular to adapt it to a desired strength distribution for the component, which is to be produced, in that locally different cooling efficiencies are adjusted in the forming tool. A tempering, which is adjusted in such a manner ("tailored tempering") can be attained, for example, by means of differently dimensioned cooling ducts or cooling duct bore diameters, respectively.

The tool elements of the forming tool according to the invention can comprise one or a plurality of drilled cooling ducts, which branch within the tool element. In particular, the branched cooling duct can also comprise a plurality of branching points, wherein the cooling duct branches of the respective tool element can all end on one of the two joining surfaces of the tool element, or also partly on the one of the two joining surfaces and for the rest on the other one of the two joining surfaces. The tool elements of the forming tool according to the invention can also comprise tool elements without cooling ducts as well as tool elements comprising one or a plurality of cooling ducts, which do not branch. One or a plurality of tool elements, which comprise one or a plurality of cooling ducts in the form of bores, which do not branch, can thus be arranged, for example, between two tool elements, which in each case comprise at least one cooling duct which branches into at least two cooling duct branches within the tool element.

To reach a highest possible flow rate of cooling medium or cooling efficiency, respectively, it is furthermore advantageous when, according to a preferred embodiment of the forming tool according to the invention, the sum of the clear cross sectional surfaces of the at least two cooling duct branches lies in the range of 1-time to 1.3-times, preferably in the range of 1-time to 1.2-times the clear cross sectional surface of the branching cooling duct. The diameter of the branching cooling duct, for example, can be 12 mm, while two cooling duct branches, which branch off from the cooling duct, in each case comprise a diameter of 9 mm. The sum of the clear cross sectional surfaces of the two cooling duct branches is approx. 127.2 $mm^2$ in this case, while the branching cooling duct comprises a clear cross sectional surface of approx. 113.1 $mm^2$.

With reference to an even cooling of the hot sheet component, it is further advantageous when, according to a further embodiment of the invention, the shortest radial distance of the respective cooling duct branch from the forming surface equals the shortest radial distance of a further one of the at least two cooling duct branches or differs therefrom by not more than 20%, preferably by not more than 10%. In this context, a further preferred embodiment of the forming tool according to the invention provides for the shortest distance of the respective branching cooling duct from the forming surface to be equal to the shortest distance of one of the at least two cooling duct branches or for it to differ therefrom by not more than 20%, preferably by not more than 10%.

According to a further preferred embodiment, provision is made for the shortest radial distance of the respective cooling duct branch and/or of the branching cooling duct from the forming surface of the tool element to be in the range of 0.5 to 1.2-times the diameter of the respective cooling duct branch or of the branching cooling duct, respectively.

In particular with respect to the production of very complexly shaped sheet steel components, it is advantageous for the even cooling of certain sections of the forming tool when the cooling medium flow branches several times in longitudinal direction of the sheet steel component. A further embodiment of the forming tool according to the invention provides accordingly for at least one of the cooling duct branches of one of the tool elements to be connected to a cooling duct of the next tool element, which branches within this next tool element into at least two further cooling duct branches, wherein the bore axes of these further cooling duct branches extend along the forming surface.

A further advantageous embodiment of the forming tool according to the invention is characterized in that the female mold thereof comprises at least one movable base part. By means of the movable base part of the female mold, a more accurate positioning of the sheet metal blank, which is to be shaped, can be attained with reference to the forming surfaces of the forming tool at the onset and during the forming process.

According to a preferred embodiment of the invention, a particularly reliable leakage-free sealing on the abutting surfaces facing one another of the tool elements resting against one another can be attained in that the cooling ducts and/or cooling duct branches, which are connected to one another, of the tool elements resting against one another, are provided with annular recesses for accommodating a seal. The seal is here preferably formed from a sleeve-shaped insert, in the lateral surface of which at least two annular grooves, which are axially spaced apart from one another, are embodied, in which rubbery-elastic sealing rings are arranged. The seal embodied in such a manner allows for an axial and/or radial displaceability of the tool elements resting against one another, without resulting in a leakage. An axial displacement of the tool elements can occur in particular due to a temperature-related expansion or shrinking, respectively, of individual or of a plurality of the tool elements. A radial displaceability is advantageous in the case of component deviations.

Further preferred and advantageous embodiments of the forming tool according to the invention are specified in the dependent claims.

The invention will be explained below with reference to a drawing which illustrates a plurality of exemplary embodiments. Schematically, FIG. 1 shows a vertical cross sectional view of a section of a forming tool for hot forming and press-hardening sheet metal at the onset of the forming process;

Figure 1:
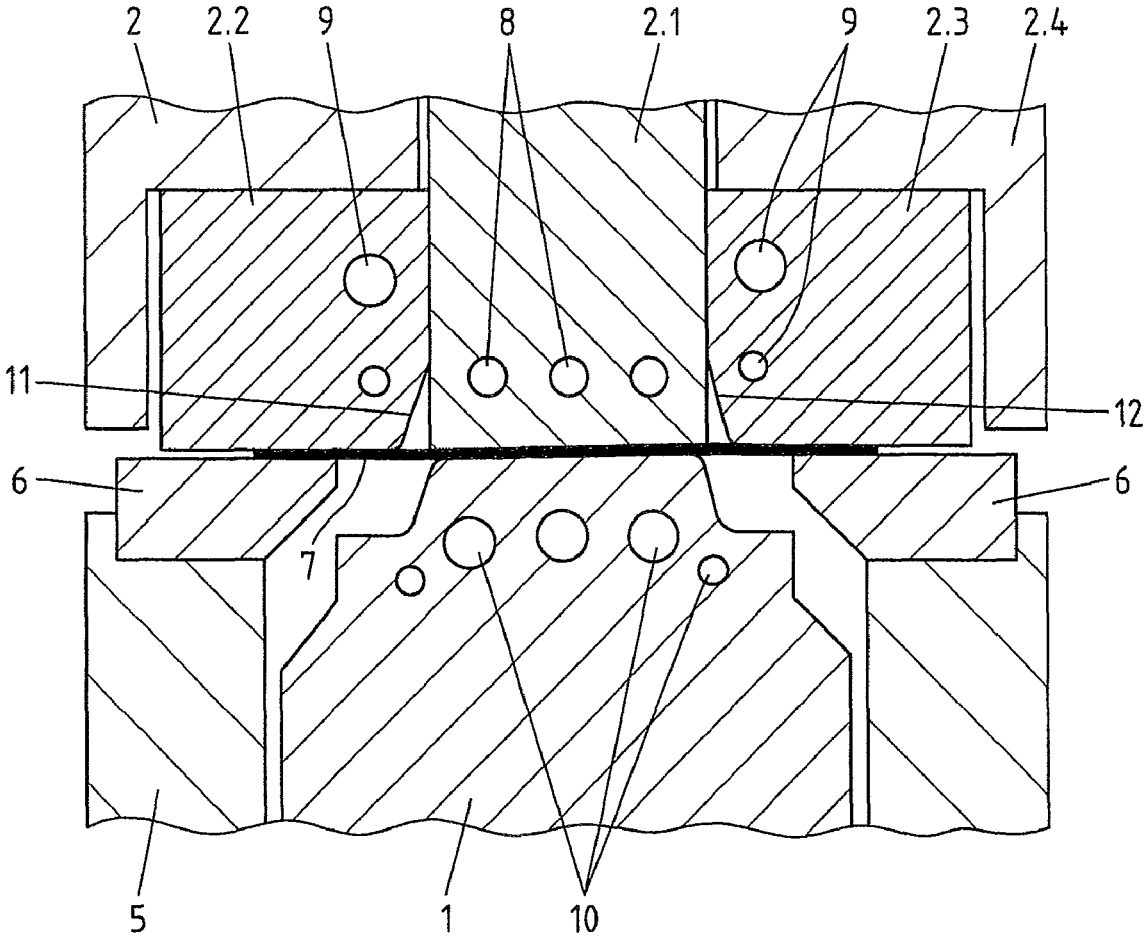
Figure 2:
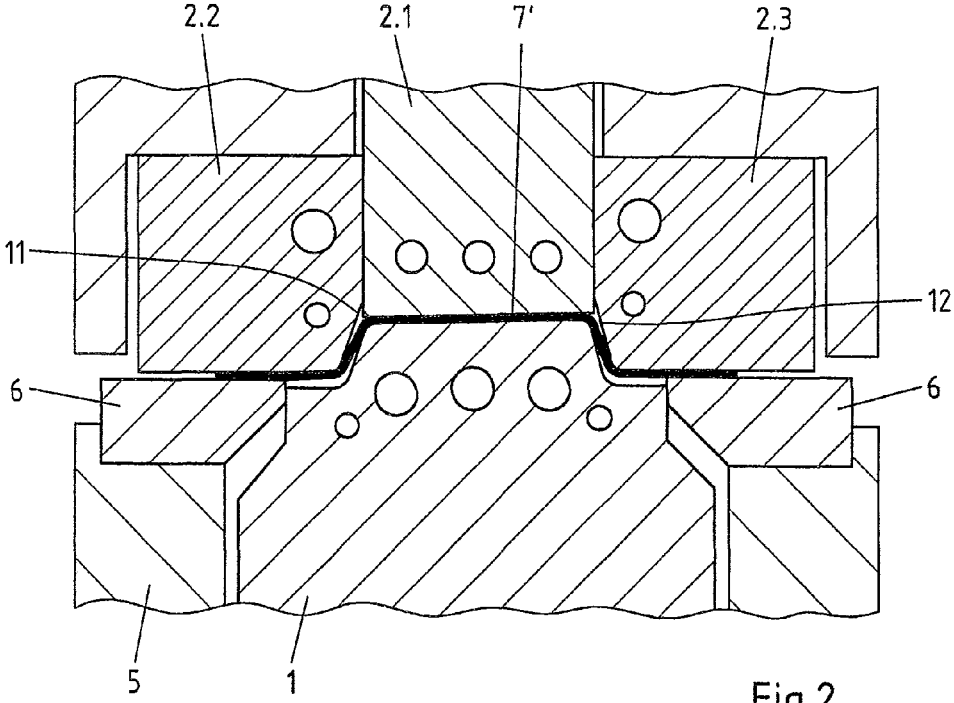
FIG. 2 shows the forming tool of FIG. 1, again in vertical cross sectional view, shortly prior to the end of the forming process.
Figure 3:
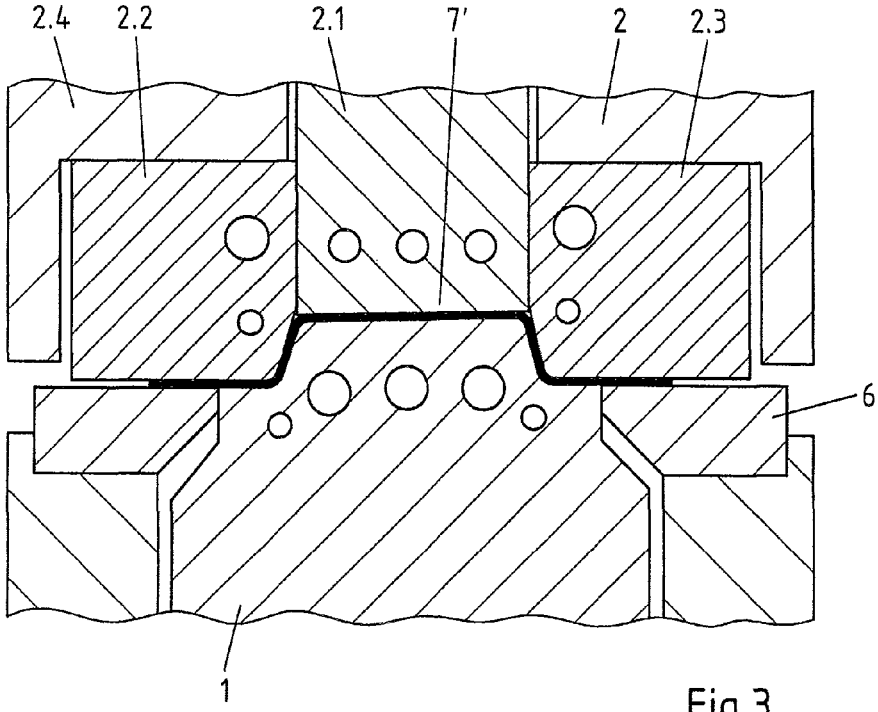
FIG. 3 shows the forming tool of FIG. 1 at the end of the forming process.

The forming tool illustrated in FIGS. 1 to 3 serves for hot forming and press-hardening sheet metal, preferably boron-alloyed sheet steel. The forming tool (pressing tool) is composed of a male mold 1 and a female mold 2. The female mold 2 is arranged within a machine frame 5, to which holders 6 for holding the sheet metal blank 7, which is to be formed, are mounted on the upper side.

The female mold 2 comprises a movable base part 2.1 which is arranged between lateral tool elements (blocks) 2.2, 2.3 of the female mold. In the open position of the forming tool, the movable base part 2.1 projects with its forming surface, which faces the male mold 1, beyond the forming surfaces of the lateral tool elements 2.2, 2.3 of the female mold. The movable bottom part 2.1 serves as counter-pressure element for the male mold 1 and thus optimizes the positional fixation of the sheet metal blank during the forming process by clamping it.

The tool elements (blocks) 2.2, 2.3 are detachably connected to a base part (base frame) 2.4 of the female mold 2, which serves as a support. The blocks 2.2, 2.3 and the base part 2.1 of the female mold 2 as well as the male mold 1 comprise cooling ducts 8, 9, 10 through which cooling medium, for example cold water, is guided for quickly cooling down the sheet steel blank 7 which was previously heated to austenitization temperature in a heat treatment system. In the illustrated exemplary embodiment, the blank holders 6 do not contain any cooling ducts. However, it is also possible for blank holders 6 comprising integrated cooling ducts to be used in a forming tool according to the invention, if need be.

Figure 4:
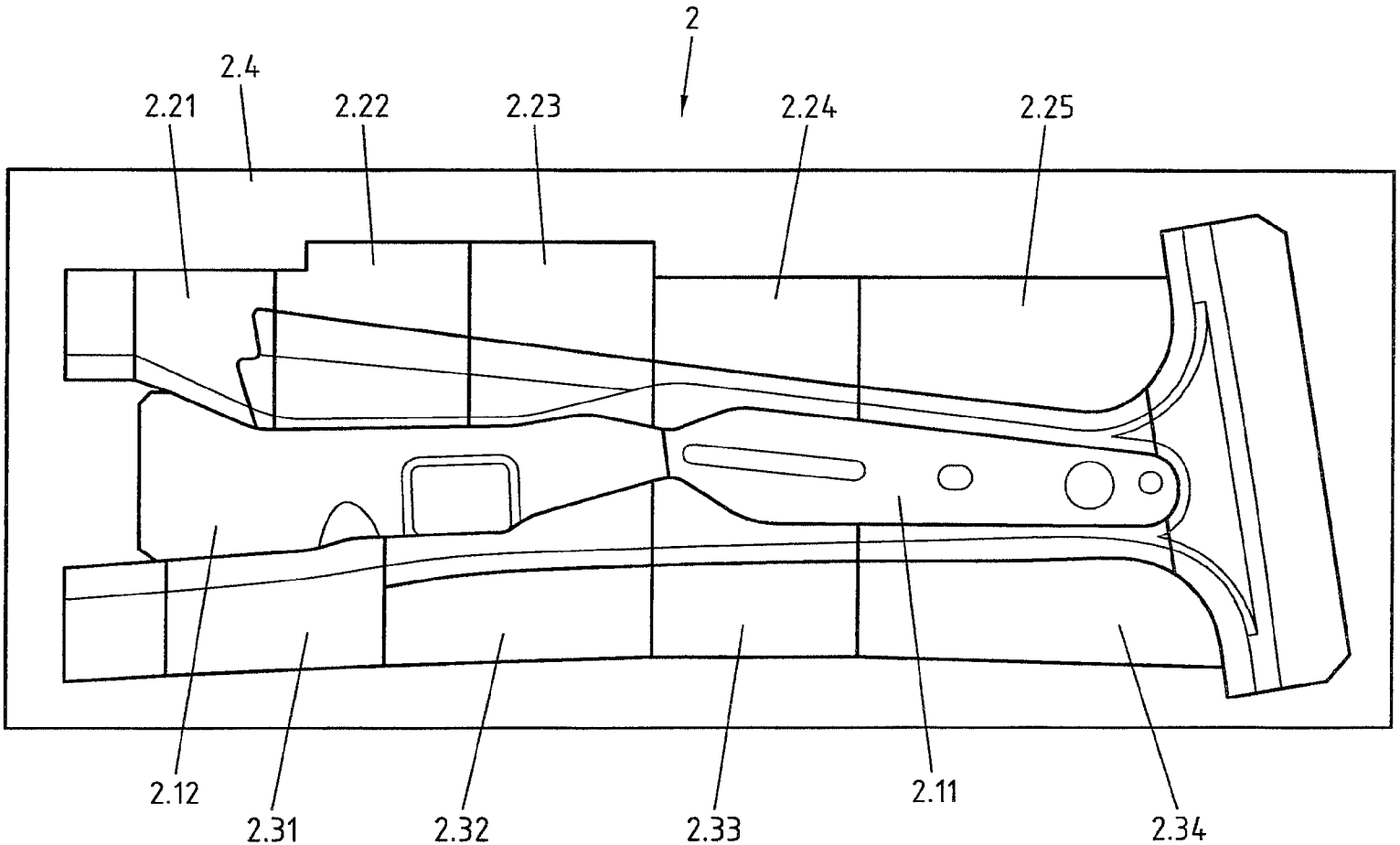
FIG. 4 shows a female mold of a forming tool according to the invention in top view.
Figure 5:
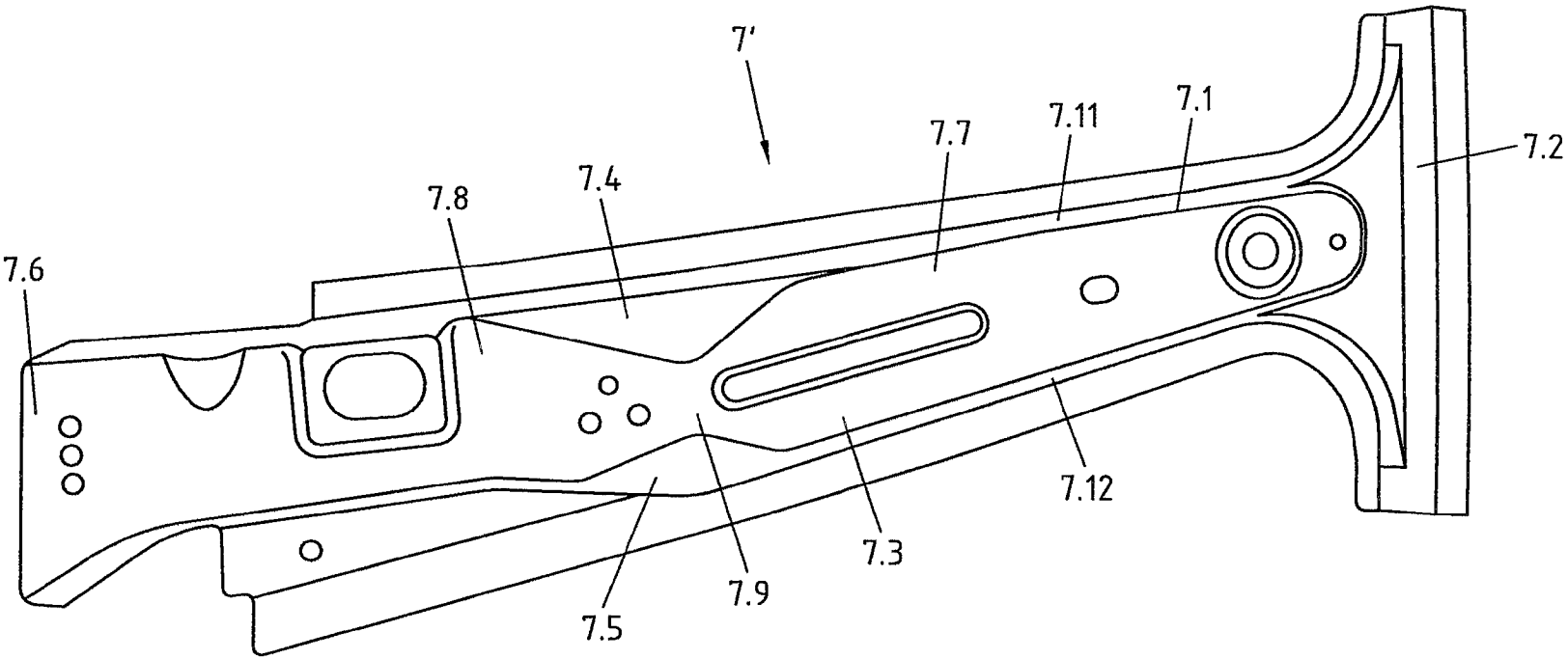
FIG. 5 shows a component, which is produced by means of a forming tool according to the invention.

FIG. 4 illustrates a female mold 2 of a forming tool according to the invention in a top view, by means of which an elongate formed component 7' can be produced from a sheet steel blank 7. The formed sheet component 7' is a B-column of a motor vehicle body, which is illustrated in FIG. 5. The cross sectional profile of the component 7' changes over the length thereof. It comprises a channel-shaped bulge 7.1, which widens gradually from the upper connection area 7.2 to the central longitudinal section 7.3. The shoulders 7.11, 7.12 of the bulge 7.1 run from top to bottom area by area in a relatively straight manner. At the central longitudinal section 7.3, the shoulders 7.11, 7.12 merge into angular faces 7.4, 7.5, which are located opposite one another and which define a constriction 7.9 of the channel-shaped bulge 7.1. Below the constriction 7.9, the shoulders 7.11, 7.12 of the bulge 7.1 run substantially parallel to one another until they finally diverge towards the lower end 7.6 of the column. The outer side of the bulge 7.1 comprises two substantially planar surface areas 7.7, 7.8, which meet in an obtuse angle in the area of the constriction 7.9.

The shoulders 7.11, 7.12 of the channel-shaped bulge 7.1 of the component 7' were formed by the forming surfaces of the lateral tool elements (blocks) 2.2, 2.3 and the substantially planar surface areas were formed by the forming surfaces of the movable base part 2.1 of the female mold 2. The movable base part 2.1 of the female mold is here embodied in two pieces, wherein the one movable part 2.11 is assigned to the upper outside area 7.7 and the other movable part 2.12 is assigned to the lower outside area 7.8 of the bulge 7.1.

As is shown in FIG. 4, a plurality of tool elements (blocks) 2.21, 2.22, 2.23, 2.24, 2.25, 2.31, 2.32, 2.33, 2.34, which rest against one another and which are detachably connected to the base part 2.4 of the female mold 2 serving as support, are in each case arranged on both sides of the movable base parts 2.11, 2.12 of the female mold 2. Preferably, the detachable connection consists of screw connections.

Figure 6:
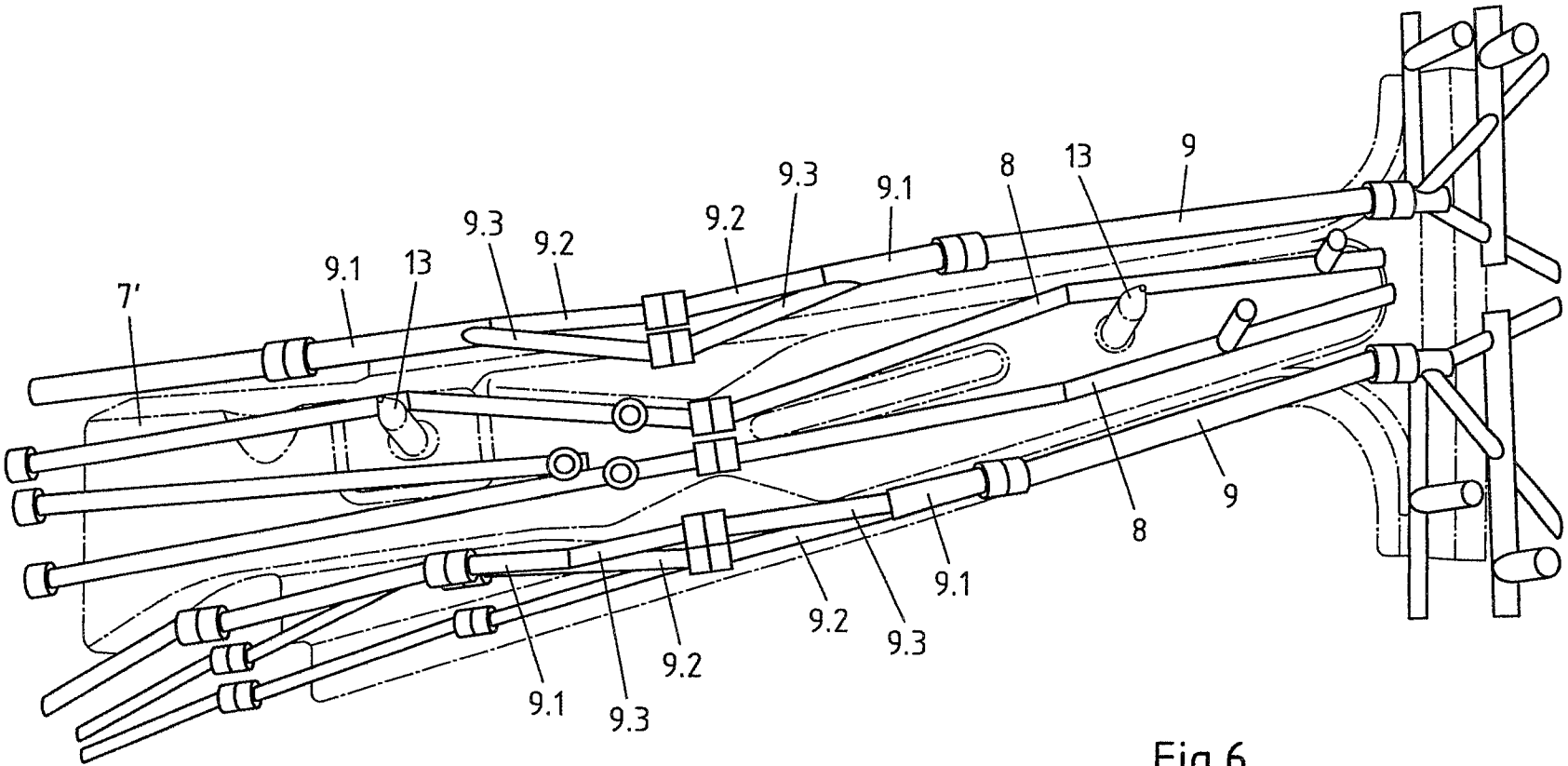
FIG. 6 shows a cooling duct structure or arrangement, respectively, in a (non-illustrated) female mold according to FIG. 4, wherein, however, the component according to FIG. 5 is indicated by means of dash-dotted lines.

The tool elements 2.21, 2.22, 2.23, 2.24, 2.25, 2.31, 2.32, 2.33, 2.34 as well as the movable base parts 2.11, 2.12 comprise cooling ducts 8, 9, which are embodied as bores and which extend along the forming surface (see FIG. 1). The arrangement of the cooling ducts of the female mold 2 of FIG. 4 is illustrated in FIG. 6 without the female mold, wherein the contour of the shaped component (B-column) 7' according to FIG. 5 is additionally drawn in dash-dotted lines so as to clarify the course of the drilled cooling ducts 8, 9, which is adapted to the forming surfaces of the female mold 2.

Reference numeral 13 identifies centering pins of the forming tool, which penetrate holes of the component 7', which have been die cut from the metal blank 7 prior to the hot forming or press-hardening, respectively.

According to the invention, a plurality of the blocks 2.23, 2.24, 2.32, 2.33 of the forming tool in each case comprise at least one drilled cooling duct 9.1, which is branched within the block 2.23, 2.24, 2.32 or 2.33, respectively, into two drilled cooling duct branches 9.2, 9.3, wherein the bore axes of the cooling duct branches 9.2, 9.3 extend substantially contour-parallel to the adjacent forming surface of the female mold. The cooling duct 9.1 and the cooling duct branches 9.2, 9.3, which branch off therefrom, form a Y-shaped or bifurcate cooling duct arrangement within the block 2.23, 2.24, 2.32 or 2.33, respectively. The bore diameters are 9 mm, 12 mm and 16 mm, for example. A drilled cooling duct comprising a diameter of 16 mm is then divided into two drilled cooling duct branches, for example, which in each case comprise the same diameter of 12 mm, while a drilled cooling duct 9.1 comprising a diameter of 12 mm is divided into two drilled cooling duct branches 9.2, 9.3, which in each case have a diameter of 9 mm.

The number of the tool elements (blocks) 2.21, 2.22, 2.23, 2.24, 2.25, 2.31, 2.32, 2.33, 2.34, which are arranged on both sides of the movable base parts 2.11, 2.12 of the female mold 2, depends on the form of the component 7' which is to be produced, in particular on the number of the constrictions 7.9 and/or the widenings of the component 7'. The bore axes of the cooling ducts 9, 9.1 or of the cooling duct branches 9.2, 9.3, respectively, follow the contour of the forming surface of the female mold or of the forming surface of the male mold, respectively. A quick even cool-down of the component 7' and thus an uniform hardening in response to the press-hardening is thus attained by means of the illustrated arrangement of the cooling ducts 8, 9, 9.1, 10 and of the cooling duct branches 9.2, 9.3 within the male mold 1 or the blocks 2.21, 2.22, 2.23, 2.24, 2.25, 2.31, 2.32, 2.33, 2.34, respectively, and movable base parts 2.11, 2.12 of the female mold 2.

Figure 7:
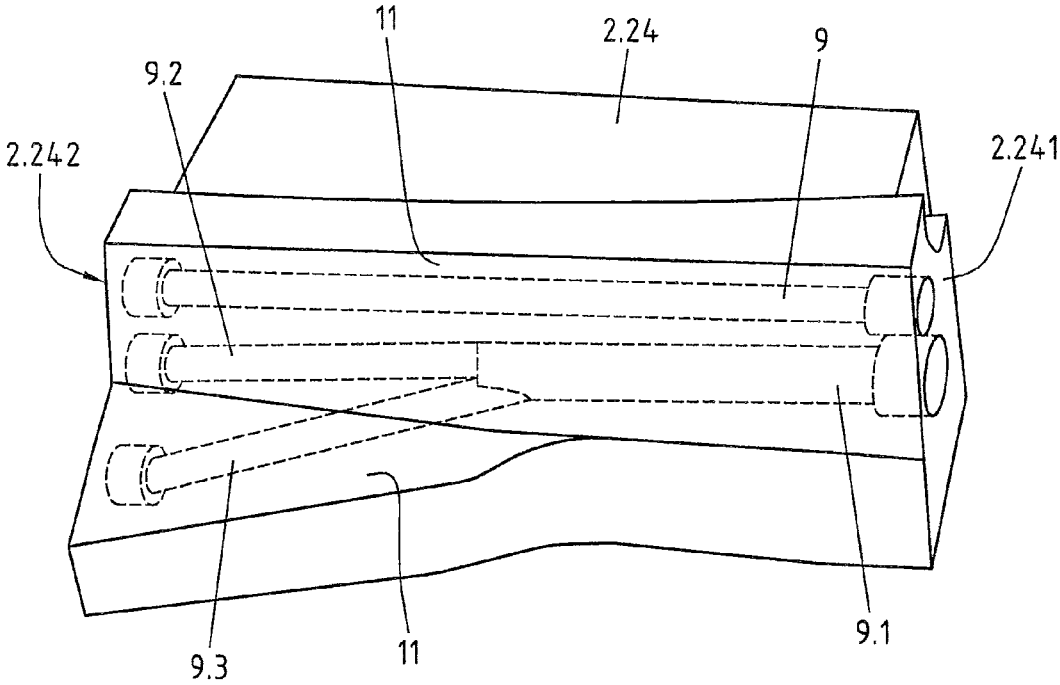
FIG. 7 shows a tool element of a female mold of a forming tool according to the invention.

In addition to a drilled cooling duct 9.1, which is divided into two cooling duct branches 9.2, 9.3 within the tool element 2.24, the block-shaped tool element 2.24 illustrated in FIG. 7 comprises a further cooling duct 9, which does not branch and which extends from the one joining surface 2.241 to the opposite joining surface 2.242. It can be seen in FIG. 7 that the drilled cooling ducts 9, 9.1 and cooling duct branches 9.2, 9.3 run contour-parallel to the forming surface 11 of the tool element 2.24.

Figure 8:
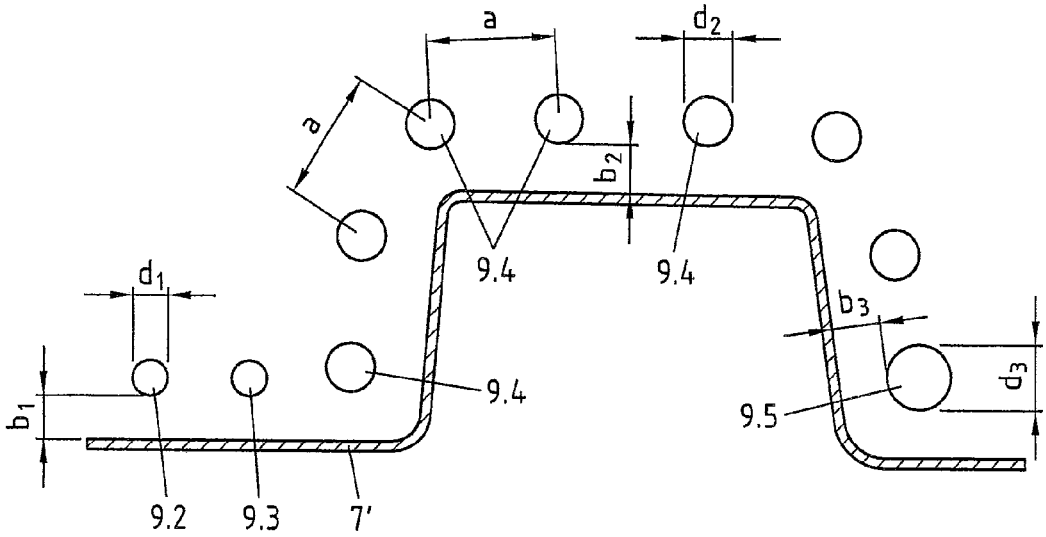
FIG. 8 shows a cooling duct arrangement in a female mold, which is not illustrated in detail, in cross sectional view.

It is furthermore illustrated in FIG. 8 that, even when they have different diameters $d_1$, $d_2$ and $d_3$, the drilled cooling ducts 9.4, 9.5 and cooling duct branches 9.2, 9.3 of the female mold of the forming tool according to the invention are in each case nonetheless arranged at approximately the same distance $b_1$, $b_2$ and $b_3$ to the forming surface, wherein the latter is illustrated herein by means of the profile of the produced component 7'. The bores 9.1, 9.2 comprising the diameter $d_1$, for example 9 mm, are in each case arranged at a distance $b_1$ of approx. 10.5 mm to the forming surface of the female mold, while the bores 9.4, 9.5 comprising the diameter $d_2$ or $d_3$, respectively, of 12 mm, for example, in each case comprise a distance $b_2=b_3$ of approx. 12 mm to the forming surface of the female mold. The radial distance a of the bore axes of the adjacent bores 9.4 is substantially also equal herein.

Figure 9:
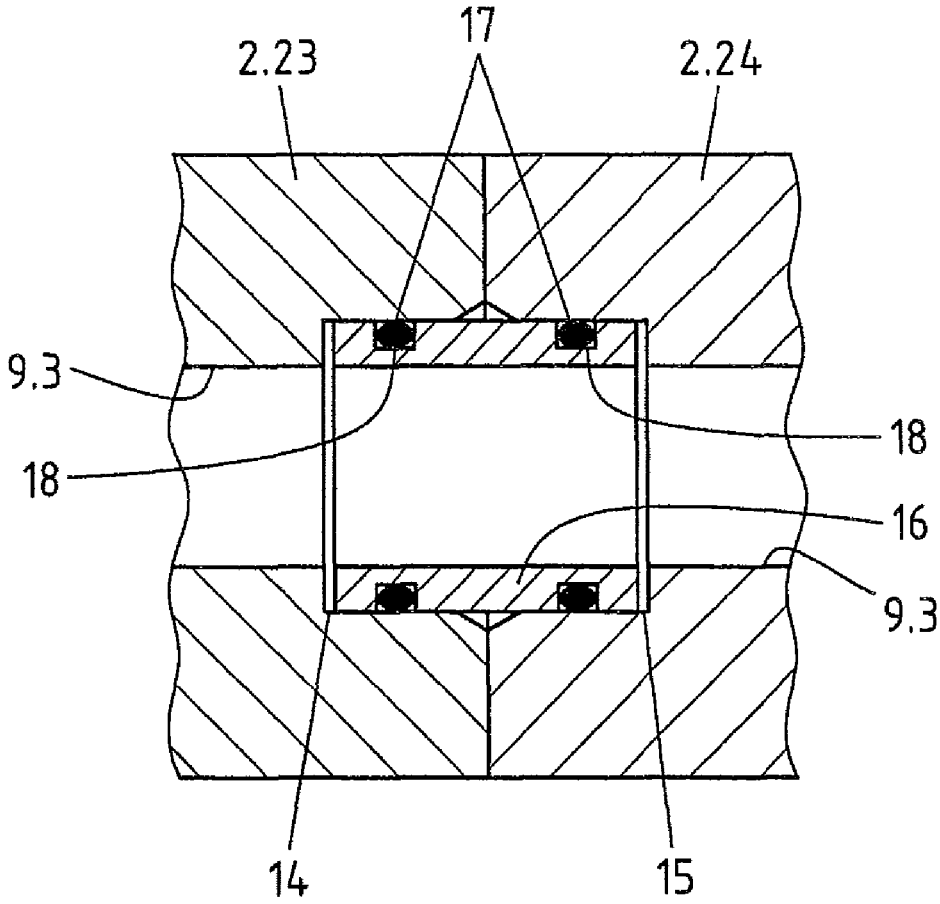
FIG. 9 shows a section of two tool elements, which rest against one another, of a forming tool according to the invention comprising cooling ducts, which are connected to one another, in sectional view.

FIG. 9 finally illustrates an exemplary embodiment for a coolant-guiding sealing connection of the drilled cooling ducts 9, 9.1 or cooling duct branches 9.2, 9.3, respectively (see FIG. 7). The cooling ducts 9, 9.1, which are connected to one another, or cooling duct branches 9.2, 9.3 of the tool elements 2.21, 2.22, 2.23, 2.24, 2.25, 2.31, 2.32, 2.33, 2.34, which rest against one another, respectively, are here provided with annular recesses 14, 15 for accommodating a seal. The seal is formed from a sleeve-shaped insert 16, in the lateral surface of which at least two annular grooves 17, which are axially spaced apart from one another, are embodied, in which rubbery-elastic seal rings 18 are arranged. The sleeve-shaped insert 16 has substantially the same inner diameter as the bores 9.3, which are connected by means of the insert 16. The length of the sleeve-shaped insert 16 is larger than the bore diameter of the connected cooling ducts 9, 9.1 or of the cooling duct branches 9.3, respectively. With reference to the recesses 14, 15, the length of the insert 16 is dimensioned such that a play (clearance) is available at least on one side between the front faces of the insert 16 and the surfaces of the recesses 14, 15 facing the front faces. The play S lies in the range of 1 to 4 mm, preferably of 1 to 2 mm, for example. The sealing construction illustrated in FIG. 9 allows for an axial displacement of the tool elements 2.23, 2.24 as well as of the insert 16 relative to one another across a wide range without the occurrence of a leakage at the seal. In the event that a radial displaceability is to be made possible, the outer diameter of the insert 16 must be chosen to be smaller than the diameter of the recesses 14, 15.

Figure 10:
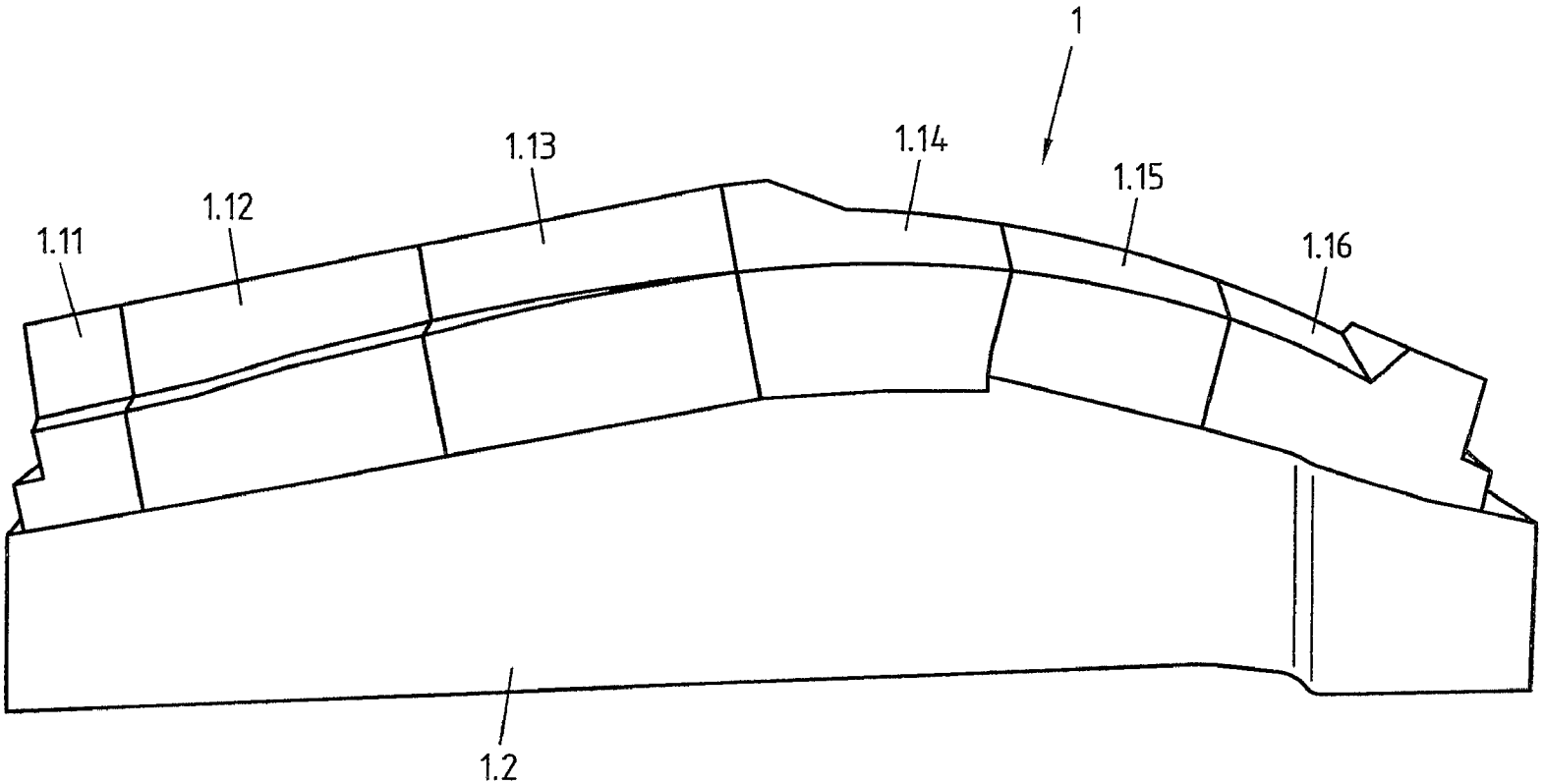
FIG. 10 shows a male mold of a forming tool according to the invention in side view.

FIG. 10 illustrates a male mold 1 of the forming tool according to the invention. It can be seen that a plurality of tool elements 1.11, 1.12, 1.13, 1.14, 1.15, 1.16 are assembled on a male mold base frame 1.2 so as to rest against one another. Analogous to the tool elements 2.23, 2.24 of the female mold plate 2, the tool elements 1.11, 1.12, 1.13, 1.14, 1.15, 1.16 of the male mold 1 comprise drilled cooling ducts extending along the forming surface, wherein at least two of the tool elements 1.11, 1.12, 1.13, 1.14, 1.15, 1.16 in turn in each case comprise at least one cooling duct 9.1 which branches within the tool element into at least two cooling duct branches 9.2, 9.3 and wherein the bore axes of the cooling duct branches 9.2, 9.3 extend along the forming surface.

The leakage-free sealing of the tool elements 1.11, 1.12, 1.13, 1.14, 1.15, 1.16 of the male mold 1 is embodied as in the case of the tool elements 2.23, 2.24 of the female mold 2 according to FIG. 9.

The embodiment of the forming tool according to the invention is not limited to the afore-described exemplary embodiments. Instead, numerous alternatives are possible, which use the invention specified in the enclosed claims even in the case of a fundamentally different design.

The invention claimed is:

1. A forming tool for hot forming, comprising: a plurality of tool elements, which rest against one another and which define a forming surface, wherein the forming surface is embodied so as to be complementary to at least one section of a formed sheet component, which is to be produced by means of hot forming, wherein the tool elements comprise cooling ducts in the form of bores, which extend along the forming surface, wherein at least two of the tool elements in each case comprise at least one cooling duct, which branches within the tool element into at least two cooling duct branches, and wherein bore axes of the cooling duct branches extend along the forming surface.

2. The forming tool according to claim 1, wherein a sum of clear cross sectional surfaces of the at least two cooling duct branches lies in the range of 1-time to 1.3-times the clear cross sectional surface of the branching cooling duct.

3. The forming tool according to claim 1, wherein a shortest radial distance of the respective cooling duct branch from the forming surface equals a shortest radial distance of a further one of the at least two cooling duct branches or differs therefrom by not more than 20%.

4. The forming tool according to claim 1, wherein a shortest radial distance of the respective branching cooling duct from the forming surface equals a shortest radial distance of one of the at least two cooling duct branches or differs therefrom by not more than 20%.

5. The forming tool according to claim 1, wherein a shortest radial distance of the respective cooling duct branch or of the branching cooling duct from the forming surface of the tool element lies in a range of 0.5 to 1.2-times a diameter of the respective cooling duct branch or of the branching cooling duct.

6. The forming tool according to claim 1, wherein at least one of the cooling duct branches of one of the tool elements is connected to a cooling duct of the next tool element, which branches within this next tool element in at least two further cooling duct branches, wherein the bore axes of these further cooling duct branches extend along the forming surface.

7. The forming tool according to claim 1, wherein the cooling ducts, which are connected to one another or the cooling duct branches of the tool elements, which rest against one another, are provided with annular recesses for accommodating a seal.

8. The forming tool according to claim 7, wherein the seal is formed from a sleeve-shaped insert, in a lateral surface of which at least two annular grooves, which are axially spaced apart from one another, are embodied, in which rubbery-elastic sealing rings are arranged.

9. The forming tool according to claim 7, wherein the seal allows for an axial and/or radial displaceability of the tool elements, which rest against one another.

10. The forming tool according to claim 1, further comprising a female mold which comprises at least one movable base part.

11. The forming tool according to claim 10, wherein at least two of the tool elements, which in each case comprise at least one cooling duct which branches within the tool element into at least two cooling duct branches, are detachably connected to the base part of the female mold, which serves as a support.

12. The forming tool according to claim 10, further comprising a male mold, wherein at least two of the tool elements, which in each case comprise at least one cooling duct which branches within the tool element into at least two cooling duct branches, are detachably connected to a base part of the male mold, which serves as a support.

* * * * *